US005720401A

United States Patent [19]

Moore

[11] Patent Number: 5,720,401

[45] Date of Patent: Feb. 24, 1998

[54] FOAM FRONT HEAT INDUCTION FOIL

[75] Inventor: David N. Moore, Plainfield, Ill.

[73] Assignee: Phoenix Closures, Inc., Naperville, Ill.

[21] Appl. No.: 734,117

[22] Filed: Oct. 21, 1996

[51] Int. Cl.[6] ..... B65D 53/04

[52] U.S. Cl. ..... 215/232; 215/348; 215/349

[58] Field of Search ..... 215/232, 348, 215/349; 220/359

[56] References Cited

U.S. PATENT DOCUMENTS

| | | | |
|---|---|---|---|
| 3,632,004 | 1/1972 | Grimes | 215/349 X |
| 3,767,076 | 10/1973 | Kennedy | 215/232 |
| 4,324,601 | 4/1982 | Dembicki et al. . | |
| 4,452,842 | 6/1984 | Borges et al. | 215/348 X |
| 4,531,649 | 7/1985 | Shull | 215/232 |
| 4,588,099 | 5/1986 | Diez | 215/232 |
| 4,684,554 | 8/1987 | Ou-Yang | 215/232 X |
| 4,778,698 | 10/1988 | Ou-Yand . | |
| 4,961,513 | 10/1990 | Gossedge et al. . | |
| 5,176,271 | 1/1993 | Painchaud et al. . | |
| 5,372,268 | 12/1994 | Han | 215/232 |

*Primary Examiner*—Stephen Cronin
*Attorney, Agent, or Firm*—Welsh & Katz, Ltd.

[57] ABSTRACT

An inner seal for sealing containers by heat induction, especially when the inner seal may be in contact with the contents of the container during sealing. The inner seal includes a metallic foil layer which heats up almost instantaneously, and a foam layer which thermally insulates the foil layer from the contents of the container which may be in contact with the inner seal. The foam layer is compressed, and is consequently a poorer thermal insulator, where it contacts the land area of the neck of the container to which it is being sealed.

29 Claims, 1 Drawing Sheet

FOAM FRONT HEAT INDUCTION FOIL

FIELD OF THE INVENTION

The invention relates to an inner seal for a container and more particularly to such an inner seal which may come into contact with the contents of a container during application of the inner seal to the container.

BACKGROUND OF THE INVENTION

A heat sealable inner seal is often used in sealing a container for products such as anti-freeze, peanut butter, mayonnaise, liquid detergent, etc. Such an inner seal prevents leakage and is also popular for providing an indication of whether there has been tampering with the contents of a container.

Presently, a heat sealable inner seal generally includes an upper layer of metallic foil which is attached to a lower layer of heat sealable material. The inner seal also frequently includes an upper backing layer. Generally, the inner seals are inserted into caps and shipped to a packager of containers. The packager places the caps onto filled containers, with the coating of heat sealable material being in contact with the land area of the neck of the containers. The containers then pass under an induction heater which generates heat within the metallic foil causing the temperature of the foil to increase. The high temperature of the foil melts the attached heat sealable layer, causing the inner seal to bond to the container.

If the foil is heated to too low a temperature, the bonding between the heat sealable layer and container may be weak or may not occur, thus preventing the inner seal from performing its sealing function. If the metallic foil is heated to too high a temperature, the heat sealable layer may burn which may also prevent proper sealing. Therefore, it is desirable to heat the foil to a temperature within a desired temperature range to ensure proper bonding of the inner seal to the container.

In many applications, it may be difficult to heat the metallic foil to the proper temperature consistently when serially sealing a number of containers. One such application is when the contents of the container may on occasion come in contact with the inner seal during the heat induction process. For example, when sealing a series of containers having contents such as mayonnaise or peanut butter, the upper surface of the contents of a random number and sequence of these containers may contact the inner seal prior to the induction heating. In those instances, the contents act as a heat sink which draws heat away from the metallic foil during the induction heating, thereby preventing the foil from reaching the desired temperature. To compensate for that loss of heat, the energy transmitted to the metallic foil can be increased. However, if a following container does not have the contents in contact with the inner seal, the metallic foil would be heated to too high a temperature, thereby burning the heat sealable material and/or the container.

SUMMARY OF THE INVENTION

Therefore, an object of the present invention is to provide a container inner seal which does not have the above mentioned drawbacks.

More particularly, an object of the present invention is to provide an inner seal for preventing leakage from a container and indicating whether there was tampering with the contents of the container.

Another object of the present invention is to provide an inner seal which can be bonded to a container by induction heating.

A still further object of the present invention is to provide an inner seal which consistently can be heated to a temperature within a desired temperature range during induction heating, regardless of whether the contents of the container are in contact with the inner seal.

It is also an object of the present invention to provide a container including such an inner seal, and a method of sealing a container using such an inner seal.

The inner seal of this invention includes a metallic foil layer, and a foam layer which faces the opening of the container and is in contact with the land area of the neck surrounding the opening. The metallic foil layer heats up almost instantaneously during induction heating. The foam layer can then melt and bond with the land area.

The foam is a relatively good thermal insulator. Consequently, during the induction heating very little heat will be drawn away from the foil layer by any contents of the container which have come in contact with the inner seal. That is, the contents will not act as a heat sink, and the foil consistently can be heated to a temperature within a desired temperature range.

A removable cap is secured around the neck of the container prior to the induction heating, compressing the foam layer where the foam layer is in contact with the land area of the neck. Where compressed, the foam is a poorer thermal insulator, and will still melt and bond with the land area during the induction heating.

A backing layer may be added to the inner seal. The backing layer may be composed of cardboard, and supplies strength to the inner seal and prevents the foil from bonding to the cap during the induction heating.

Presently, heat sealable inner seals often have backings consisting of wax bonded pulp and are glued into the caps. When, for the reasons mentioned above, there is insufficient heat to soak the wax into the pulp, it can be difficult to remove the cap from the container. The insulating properties of the present invention afford a better operating window for the power setting on the heat induction equipment, for the conveyer speed, and for the positioning of the heat induction coil.

DESCRIPTION OF THE PREFERRED EMBODIMENTS

Figure 1:
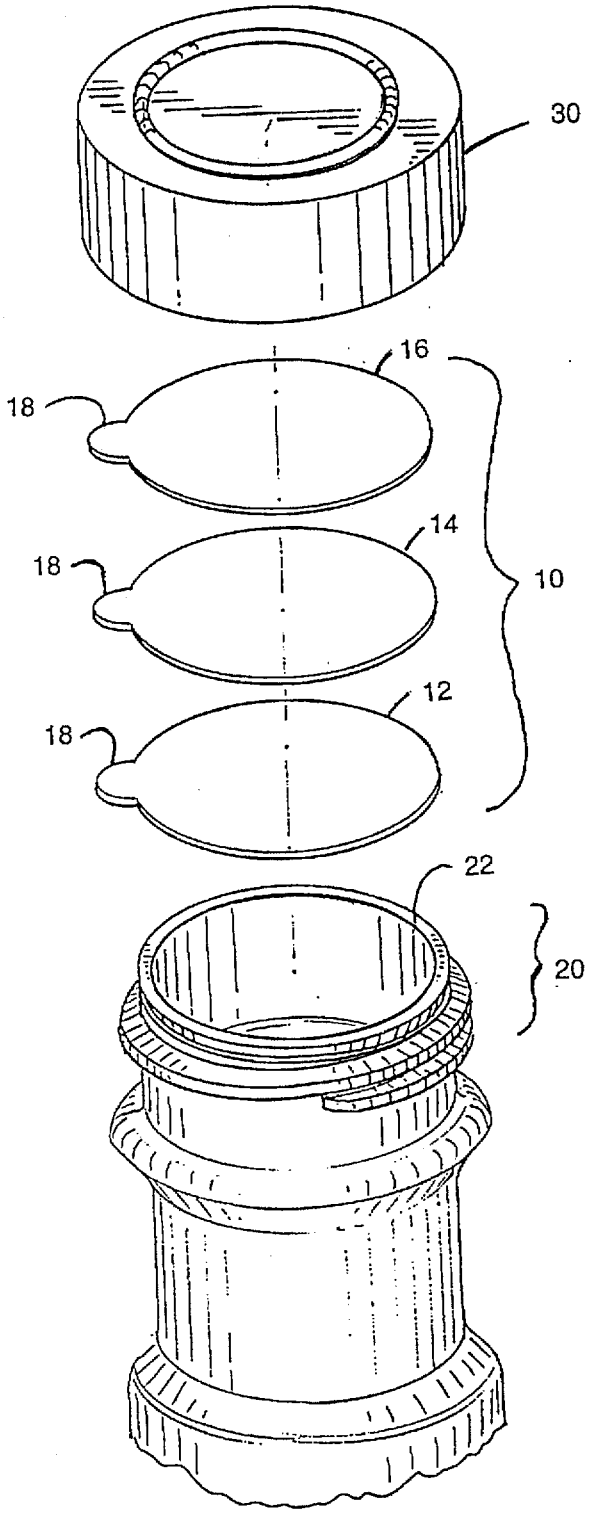
FIG. 1 is an exploded perspective view of an inner seal with a container and a cap, according to an embodiment of the present invention.

A preferred embodiment of the inner seal of the present invention is generally indicated at 10. The inner seal 10 includes a bottom layer 12 of a foamed polymeric material and a metallic foil layer 14, above the bottom layer 12. The foil layer can be any metallic foil such as aluminum. The bottom layer 12 preferably is constructed of a closed cell foam which has insulating properties, and should also be a type of material which bonds to a land area 22 of a neck 20 of a container, when the bottom layer 12 is raised to elevated temperatures. For example, if the container is composed of polyethylene, the bottom layer 12 is composed preferably of a polyethylene foam and even more preferably a cross-linked polyethylene foam. Other materials may include but are not limited to polypropylene, styrene, polybutylene, ethylene vinyl acetate, or the like.

The bottom layer 12 should range in thickness from about 0.005 inches to about 0.125 inches, preferably from about 0.005 inches to about 0.035 inches, the thicker foam being used when great insulation is needed such as when the contents of a container will likely contact a large portion of the lower surface of the bottom layer 12. A thicker layer of foam will generally be compressed to a greater degree proportionally than a thinner foam layer when it is forced down on the land area 22 of the neck 20 by a cap 30. The bottom layer 12 is attached to the foil layer 14 by means of an adhesive between the bottom layer 12 and the foil layer 14, or by other means used in the industry.

The inner seal 10 may also include a backing layer 16 which is typically, but not necessarily, attached to the foil layer 14. The attachment may be by adhesive, wax, or other suitable method. Different layers of lining systems sometimes are thermally bonded by extrudates. The backing layer 16 is typically composed of cardboard or the like, and supplies strength to the inner seal 10 and also prevents the foil layer 14 from bonding to the cap 30. Preferably, the cap 30 is formed of a non-metallic material such as a polymer and has internal threads (not shown) to mate with threads around an outside surface of the neck 20.

In operation, the inner seal 10 may be applied to a container in a conventional manner. The inner seal 1O typically is placed inside the cap 30 by a cap manufacturer, and the caps 30 typically are supplied to a packager of the containers with the inner seals be retained within the caps.

The cap 30 is attached to the neck 20. Preferably the cap 30 is attached to the neck 20 so that a portion of the bottom layer 12 is compressed against the land area 22 of the neck 20. When the cap 30 is attached by threading engagement, the compression is generated by applying a predetermined torque to the cap 30. Thicker bottom layers 12 typically will be compressed to a greater degree proportionally than thinner bottom layers 12. For example, a bottom layer of 0.125 inches may be compressed between the foil layer 14 and the land area 22 of the neck 28 to a thickness of 0.005 inches.

The inner seal 10 is then bonded to the land area 22 of the neck 20 by induction heating. As the inner seal be passes through a conventional induction heating field, the metallic foil layer 14 heats up almost instantaneously. Should the contents of the container be in contact with the inner seal 10, the insulation properties of the foam bottom layer 12 limit the flow of heat from the foil layer 14 into the contents of the container. Therefore, the foil layer 14 heats up to the desired temperature. However, the portion of the bottom layer 12 compressed against the land area 22 of the neck 20 is a poorer thermal insulator, and will still melt and bond with the land area 22 of the neck 20 during the induction heating—thereby sealing the container.

The inner seal 10 shown in FIG. 1 is of substantially the same size and configuration as the opening of the container. In the embodiment shown, the inner seal 10 has a small tab portion 18 which extends beyond the opening of the container and facilitates removal of the inner seal be by one opening the container. It is also contemplated that the inner seal 10 might not have a tab portion 18, and the inner seal 10 can be removed by many methods including use of a knife or the like.

A major advantage of the inner seal 10 of this invention is that the foil layer 14 consistently will heat up to a temperature within a desired temperature range regardless of whether the contents of the container are in contact with the inner seal 1O. The foil layer 14 will not fail to attain a high enough temperature because heat is being drawn away to the contents of the container, and will not burn the bottom layer 12 by attaining too high of a temperature. Within a desired temperature range, the portion of the bottom layer 12 compressed against the land area 22 of the neck 20 will melt and bond with the land area 22 of the neck 20, sealing the container.

Specific embodiments of this novel Foam Front Heat Induction Foil according to the present invention have been described for the purpose of illustrating the manner in which the invention may be made and used. It should be understood that implementation of other variations and modifications of the invention in its various aspects will be apparent to those skilled the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. An inner seal for sealing a container comprising:

a bottom layer composed of a foamed polymeric material, said layer having an adhering face; and a metallic foil layer, said layer have an outer face and an opposite adhering face;

wherein the adhering face of the bottom layer and the adhering face of the foil layer are joined face to face.

2. An inner seal as set forth in claim 1 wherein the foamed polymeric material of the bottom layer is a closed cell foam which has thermal insulating properties.

3. An inner seal as set forth in claim 1 wherein the foamed polymeric material of the bottom layer comprises a material selected from the group consisting of polyethylene, cross-linked polyethylene, polypropylene, styrene, polybutylene, and ethylene vinyl acetate.

4. An inner seal as set forth in claim 1 wherein the bottom layer is between about 0.005 inches and about 0.150 inches thick.

5. An inner seal as set forth in claim 1 wherein the bottom layer is between about 0.005 inches and about 0.075 inches thick.

6. An inner seal as set forth in claim 1 wherein the bottom layer is between about 0.005 inches and about 0.035 inches thick.

7. An inner seal as set forth in claim 1 wherein the adhering faces of the bottom layer and of the foil layer are joined by means of an adhesive between the two adhering faces.

8. An inner seal as set forth in claim 1 further comprising a backing layer, said layer having an adhering face, wherein the adhering face of the backing layer and the outer face of the foil layer are joined face to face.

9. An inner seal as set forth in claim 8 wherein the adhering face of the backing layer and the outer face of the foil layer are joined by means of an adhesive between said adhering and outer faces.

10. An inner seal as set forth in claim 8 wherein the backing layer is composed of cardboard.

11. An inner seal as set forth in claim 1 wherein at least the bottom layer includes a tab portion.

12. A container assembly having a container which includes a neck surrounding an opening of said container and having an inner seal, said seal comprising:

a bottom layer composed of a foamed polymeric material, said layer having an inner face and an opposite adhering face; and a metallic foil layer, said layer have an outer face and an opposite adhering face;

wherein the adhering face of the bottom layer and the adhering face of the foil layer are joined face to face, and wherein the inner face of the bottom layer faces said opening and contacts a land area of the neck.

13. A container assembly as set forth in claim 12 wherein the foamed polymeric material of the bottom layer is a closed cell foam which has thermal insulating properties.

14. A container assembly as set forth in claim 12 wherein the container is composed of polyethylene and the foamed polymeric material of the bottom layer comprises a material selected from the group consisting of polyethylene, cross-linked polyethylene, polypropylene, styrene, polybutylene, and ethylene vinyl acetate.

15. A container assembly as set forth in claim 12 wherein the bottom layer is between about 0.005 inches and about 0.150 inches thick.

16. A container assembly as set forth in claim 12 wherein the bottom layer is between about 0.005 inches and about 0.075 inches thick.

17. A container assembly as set forth in claim 12 wherein the bottom layer is between about 0.005 inches and about 0.035 inches thick.

18. A container assembly as set forth in claim 12 wherein the adhering faces of the bottom layer and of the foil layer are joined by means of an adhesive between the two adhering faces.

19. A container assembly as set forth in claim 12 wherein the inner seal further comprises a backing layer, with the foil layer associated between the backing layer and the bottom layer, said backing layer having an adhering face, wherein the adhering face of the backing layer and the outer face of the foil layer are joined face to face.

20. A container assembly as set forth in claim 12, wherein the inner seal is associated with a cap which is removably secured around the neck.

21. A container assembly as set forth in claim 20 wherein securing the cap around the neck compresses the bottom layer where the bottom layer contacts the land area of the neck.

22. A container assembly as set forth in claim 12 wherein the inner seal is bonded to the land area by induction heating.

23. A container assembly as set forth in claim 12 wherein at least the bottom layer includes a tab portion.

24. A method for sealing a container, wherein the container includes a neck surrounding an opening of the container, and the method comprises the steps of:

forming an inner seal by joining face to face a metallic foil layer and a heat sealable bottom layer;

placing the inner seal over the opening, with the bottom layer facing the opening and contacting a land area of the neck;

thermally insulating contents of the container from the foil layer by composing the bottom layer of a foamed polymeric material which has thermal insulating properties; and bonding the inner seal to the land area of the neck by induction heating.

25. A method as set forth in claim 24 wherein the insulating step is accomplished by selecting the foamed polymeric material from a group consisting of polyethylene, cross-linked polyethylene, polypropylene, styrene, polybutylene, and ethylene vinyl acetate.

26. A method as set forth in claim 24 wherein the forming step is accomplished by using as adhesive.

27. A method as set forth in claim 24, further comprising the step of securing a removable cap around the neck.

28. A method as set forth in claim 27 wherein the securing step includes compressing the bottom layer where the bottom layer contacts the land area of the neck.

29. A method as set forth in claim 28 wherein the securing step precedes the bonding step.

* * * * *

UNITED STATES PATENT AND TRADEMARK OFFICE

CERTIFICATE OF CORRECTION

PATENT NO. : 5,720,401
DATED : Feb. 24, 1998
INVENTOR(S) : Moore

It is certified that error appears in the above-indentified patent and that said Letters Patent is hereby corrected as shown below:

Col. 3, line 26, delete "be" and insert therefor --10--.
Col. 3, line 36, delete "28" and insert therefor --20--.
Col. 3, line 38, delete "be" and insert therefor --10--.
Col. 3, line 54, delete "be" and insert therefor --10--.

Signed and Sealed this
Fifth Day of May, 1998

Bruce Lehman

*Attest:*

BRUCE LEHMAN

*Attesting Officer*

*Commissioner of Patents and Trademarks*